United States Patent [19]

Balma

[11] Patent Number: 4,589,581

[45] Date of Patent: May 20, 1986

[54] ELECTROMECHANICAL DEVICE FOR AUTOMATING THE OPERATION OF TABLE STAPLERS

[75] Inventor: Giorgio Balma, Voghera, Italy

[73] Assignee: Balma, Capoduri & C., S.p.A., Voghera, Italy

[21] Appl. No.: 629,719

[22] Filed: Jul. 11, 1984

[30] Foreign Application Priority Data

Jul. 13, 1983 [IT] Italy ..... 22054 A/83

[51] Int. Cl.[4] ..... B25C 5/02; B25C 7/00

[52] U.S. Cl. ..... 227/7; 227/6; 227/130; 227/131

[58] Field of Search ..... 227/6, 7, 131, 130

[56] References Cited

U.S. PATENT DOCUMENTS 3,282,489 11/1966 March ..... 227/131 X
3,346,163 10/1967 Manganaro ..... 227/131
3,531,036 9/1970 Felson ..... 227/131 X

*Primary Examiner*—Robert L. Spruill
*Assistant Examiner*—Taylor J. Ross
*Attorney, Agent, or Firm*—Bucknam and Archer

[57] ABSTRACT

An electromechanical device associated with table staplers for automating the operation of such staplers. A box-like body houses and restrains a conventional table stapler. The body is provided with a camming member for controllably pressing on the movable arm of the stapler, to cause a metal staple to be ejected and its ends to be bent against the die arranged on the fixed arm of the stapler. A timer device releases the arm of the stapler and resets the camming member after a preset period of time.

3 Claims, 4 Drawing Figures

ELECTROMECHANICAL DEVICE FOR AUTOMATING THE OPERATION OF TABLE STAPLERS

BACKGROUND OF THE INVENTION

The present invention relates to an electromechanical device for automating the operation of table staplers, for paper and the like material.

As known, staplers directly supplied with metal staples are conventionally used in offices and the like to firmly couple paper sheets together.

Also known is the fact that the mentioned staplers are operated manually by applying, in the table type of staplers, a suitable pressure on a movable arm of the stapler.

Obviously, as a great number of stapling operations are to be carried out, for preparing a plurality of pamphlets, the operator is subjected to a stressing fatigue susceptible to negatively affect the work.

Motorized staplers are known, which, however are of very complex structure and susceptible to operation malfunctions. They thus require considerable maintenance and/or adjustments.

Furthermore, the aforementioned motorized staplers have staple containing housings of comparatively reduced size, which must be frequently reloaded with metal staples.

The reloading operation is a very complex one because of the design of the motorized stapler and consumes considerable time.

BRIEF SUMMARY OF THE INVENTION

Accordingly, the principal object of the present invention is to overcome the aforementioned drawbacks by providing an electromechanical device which automates the operation of conventional staplers supplied with metal staples, for stapling paper and the like sheet materials.

Another object of the invention is to provide an electromechanical device which automates the operation of all presently commerically available table staplers.

An object of the invention is to provide an electromechanical device for automating staplers, which device may be easily engaged with and disengaged from the staplers.

Yet another object of the invention is to provide an electromechanical device for automating staplers, which device is very simple in structure and very reliable in operation.

According to one aspect of the invention, the foregoing objects, as well as yet other objects which will become more apparent hereinafter, are achieved by an electromechanical device, for automating staplers, which device comprises a box-like body effective to house and restrain the stapler and provided with a member for pressing, as controlled, the movable arm of said stapler to cause the metal staple to be ejected and its ends to be bent against the die arranged on the fixed arm of said stapler.

BRIEF DESCRIPTION OF THE DRAWINGS

In order that the invention may be readily carried into effect, it will now be described with reference to the accompanying drawings, wherein.

DETAILED DESCRIPTION OF A PREFERRED EMBODIMENT

Figure 1:
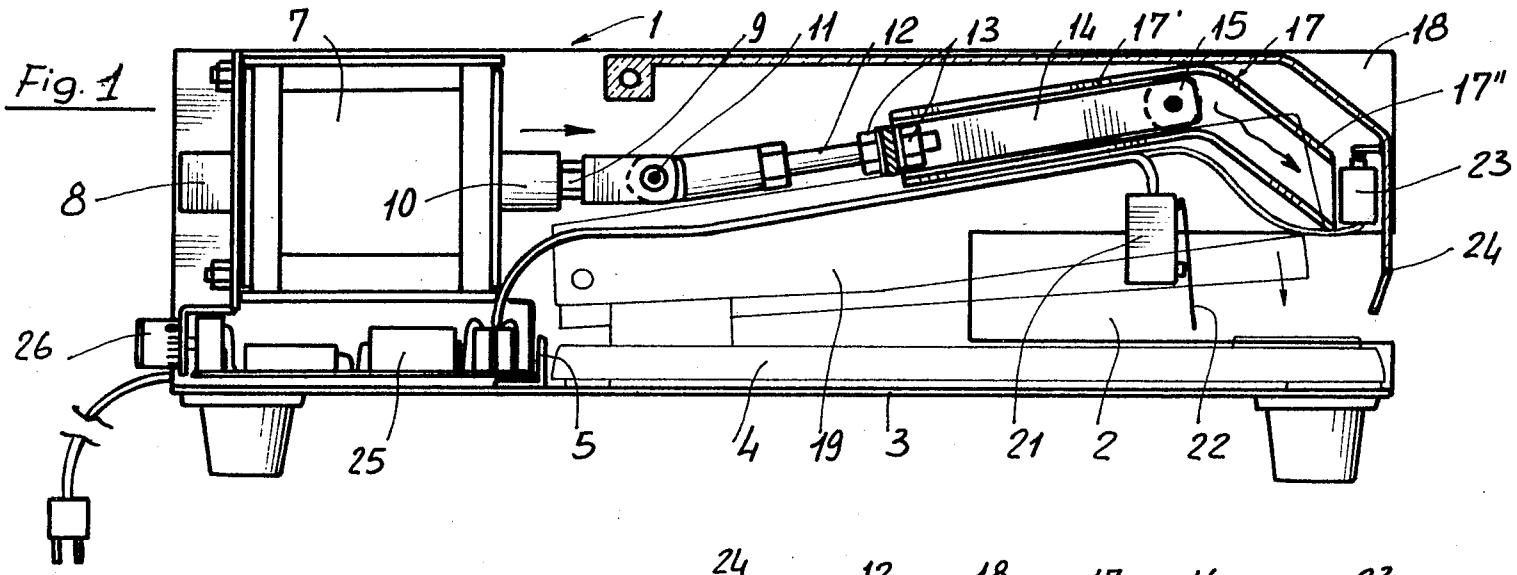
FIG. 1 is a cross-sectional view of an embodiment of the device of the invention including a conventional stapler.

With reference to the Figs. of the accompanying drawings, the electromechanical device of the invention for automating metal staple staplers comprises a parallelepipedal box-like body 1 of elongated shape having side walls provided at one end with a horizontally extending slot 2 of suitable size.

The bottom wall or panel 3 of the box-like body 1 has a width related to that of the fixed arm 4 of the stapler and is provided with ridges 5 and 6 for longitudinally restraining said arm.

An electromagnet 7 is provided at the end of the box-like body 1 opposite that having the horizontal slots. The electromagnet 7, has an armature 8 to which a spindle 9 is firmly affixed. The armature 8 projects from the casing of the electromagnet and supports coaxially, an elastomeric material pad 10, or the like.

A threaded stem 12 is coupled to the spindle 9 through a cylindrical coupling assembly 11. A fork member 14 may be mounted on the stem 12 via a nut pair 13.

The legs of the fork member 14 carry a roller 15, the axis whereof is provided at the ends and outside of said legs with two small wheels 16, restrained within corresponding guides 17. The guides 17 are cantilever-wise formed on the inside surfaces of the side walls 18 of the box-like body 1. Each of the guides 17 has a first portion 17' slightly upwardly slanted and a second portion 17'' downwardly slanted at a greater angle.

Figure 4:
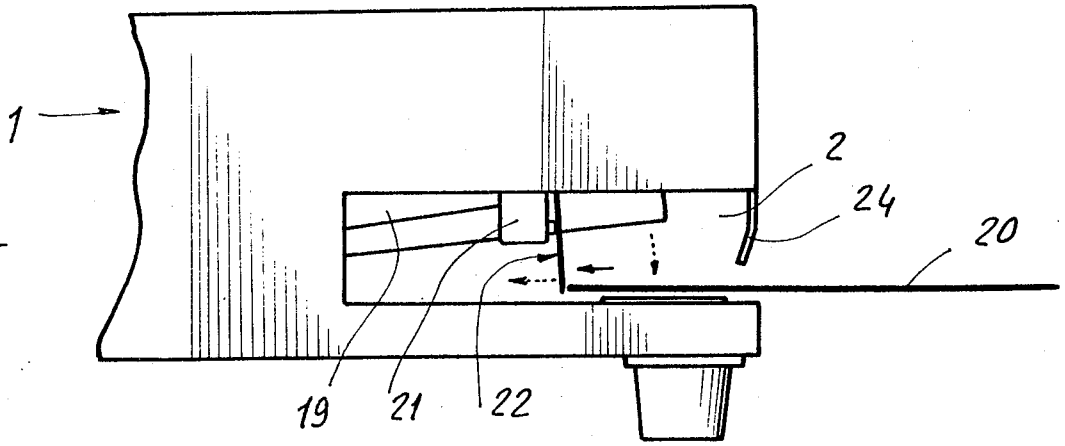
FIG. 4 illustrates the arrangement of the member controlling the operation of the device of the invention.

When the electromagnet 7 is energized, the armature 8 will push the fork member 14 and the roller 15 to move said roller along the descending portion 17'' of the guides 17. The roller 15 is thus able to downwardly press the movable arm 19 of the stapler to staple the sheets 20 to be coupled (FIG. 4).

More specifically, the closing of the energizing circuit of the electromagnet 7 is controlled by a microswitch 21, operated by a lever 22 which presses thereagainst when it engages the edges of the sheets 20 to be stapled (FIG. 1).

Figure 2:
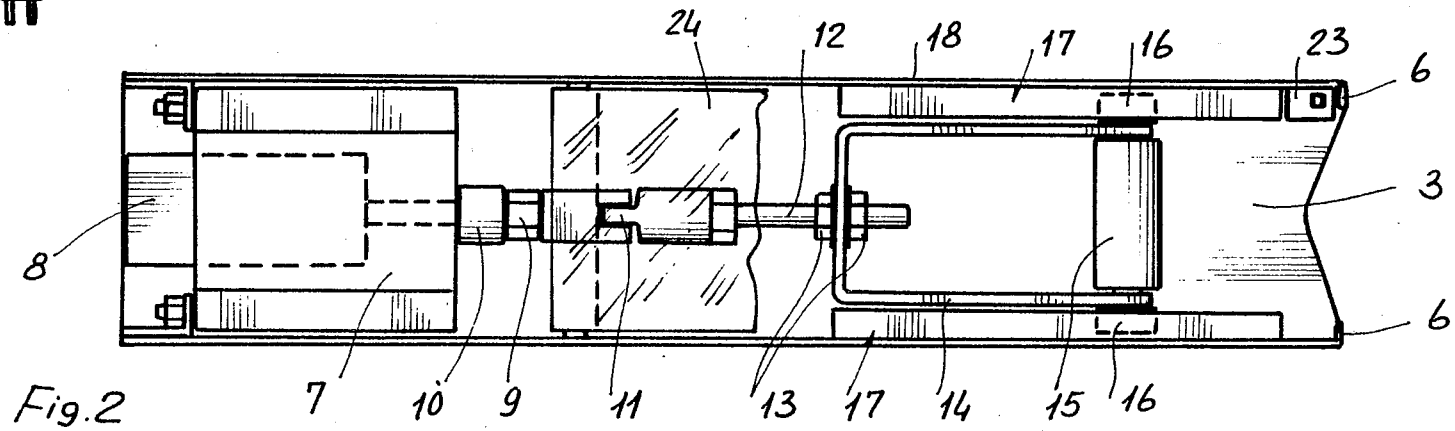
FIG. 2 is a schematic top view of the embodiment of FIG. 1.
Figure 3:
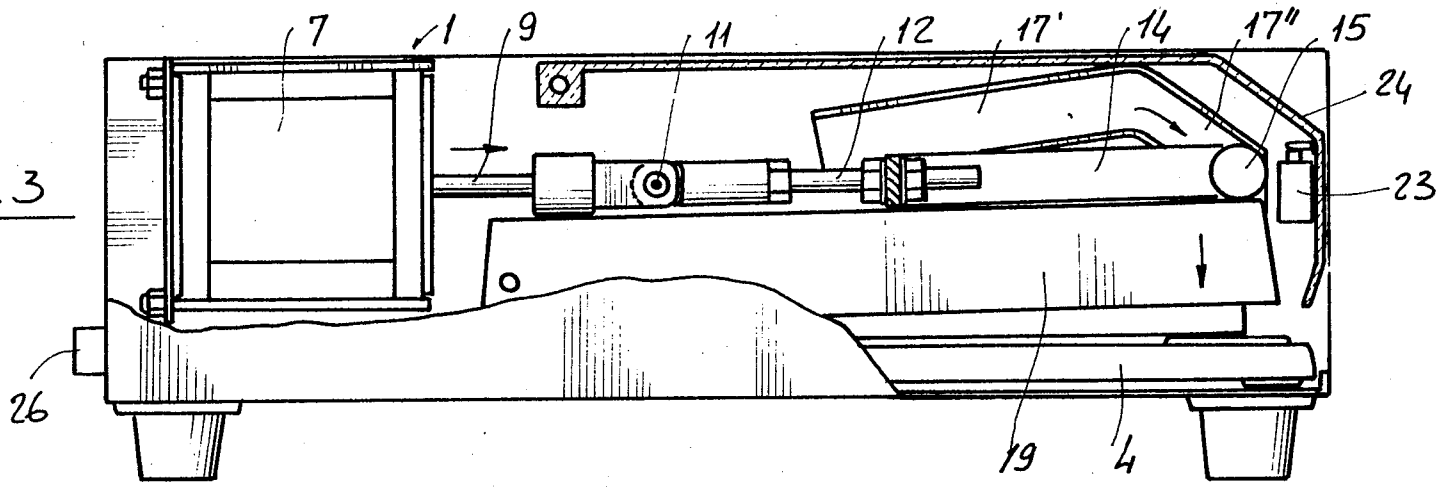
FIG. 3 illustrates the operation of the device of the embodiment of FIG. 1 on the movable arm of the stapler.

The energizing circuit of the electromagnet 7 is controlled by a second microswitch 23 (FIGS. 2 and 3), or by a limit switch, mounted on one of the side walls of the box-like body. The switch 23 is engaged by a protecting cover 24, of suitable shape, which cover is pivoted to the walls of the body. The operation of the stapler is controlled by the proper arrangement of the cover 24 in its closing condition on the box-like body 1.

The energizing circuit further comprises a timing device 25 or delay line, the operating time of which may be adjusted by means of a graduated knob 26.

After the energization of the electromagnet 7, the timing device 25 cuts off the power supply of the circuit, and resets it after a predetermined time period, independently from the removal of the sheets 20 from the lever 22 controlling the microswitch 21 by the operator.

The great functionality and use facility of the electromechanical device of the invention for automating metal staple table staplers is self-evident from the foregoing disclosure and the drawings.

In particular, the operator using the device of the invention may easily replace the stapler to replenish exhaustion of the metal staplers or with a like stapler as previously equipped in case of a malfunction.

While the electromechanical device has been disclosed with reference to a preferred embodiment thereof, it should be apparent that the disclosed embodiment is susceptible to many modifications and variations, all of which come within the scope and spirit of the invention as defined in the following claims.

We claim:

1. An electromechanical device for use with a stapler having a movable arm, a fixed arm and a die on said fixed arm, said stapler being operable, when said movable arm is moved toward said fixed arm, to eject a staple and bend the ends of the staple against said die, said device comprising a box-like body for housing and restraining a stapler, said body being of elongated parallelpipedal shape and having side walls provided at one end with a horizontally extending slot, and a bottom wall having a width related to that of the fixed arm of the stapler and having ridges extending therefrom for longitudinally restraining said fixed arm;

an electromagnet in said box-like body at the end thereof opposite that of said slots, said electromagnet having a casing and an armature projecting from said casing;

a spindle affixed to said armature;

a pad of elastomeric material coaxially affixed to said spindle;

a threaded stem;

a cylindrical coupling device coupling said stem to said spindle;

a fork member mounted on said stem and having legs;

a roller supported by the legs of said fork member, said roller having an axis;

two small wheels rotatably affixed to said roller at the spaced opposite ends of its axis outside said legs of said fork;

a pair of guides formed cantilever-wise on the inner surfaces of the side walls of said box-like body, each of said guides having a first portion slightly upwardly slanted and a second portion slanted downwardly at a greater angle than said first portion, said wheels being rotatably constrained in corresponding ones of said guides;

an energizing circuit for said electromagnet;

a microswitch in said energizing circuit for controlling said circuit; and a lever engageable with the edges of stacked sheets to be stapled for controlling said microswitch and thereby said circuit.

2. An electromechanical device as claimed in claim 1, further comprising a cover pivotally mounted on the side walls of said box-shaped body, and a limit switch connected in said circuit for controlling said circuit, said limit switch being mounted on one of the side walls of said box-shaped body and engageable by said cover.

3. An electromechanical device as claimed in claim 2, further comprising a time-adjustable timing device connected in said circuit for deenergizing said circuit after energization of said electromagnet and resetting said circuit after the lapse of a predetermined time period.

* * * * *